United States Patent [19]

Osborne

[11] 4,065,311

[45] Dec. 27, 1977

[54] GLASS PAINTING METHOD

[75] Inventor: Anthony Walter Osborne, Thursley, Godalming, England

[73] Assignee: Intechsa, S.A., Freibourg, Switzerland

[21] Appl. No.: 694,395

[22] Filed: June 9, 1976

[30] Foreign Application Priority Data

June 10, 1975 United Kingdom ..... 24919/75

[51] Int. Cl.[2] ..... G03C 5/04

[52] U.S. Cl. ..... 96/27 R; 96/41; 96/58; 427/145; 427/258; 427/269; 427/287

[58] Field of Search ..... 96/2, 27 R, 46, 52, 96/41, 58; 427/145, 258, 269, 287

[56] References Cited

U.S. PATENT DOCUMENTS

| | | | |
|---|---|---|---|
| 600,132 | 3/1898 | Baker | 96/2 |
| 1,884,565 | 10/1932 | Casto | 96/27 R |
| 2,272,117 | 2/1942 | Hasslacher et al. | 96/27 R |

*Primary Examiner*—Michael R. Lusignan
*Attorney, Agent, or Firm*—Watson, Leavenworth, Kelton & Taggart

[57] ABSTRACT

A procedure is disclosed for the production of paintings on glass, the subjects of the paintings being, for example, original paintings, engravings, lithographs and like articles whose appeal is primarily aesthetic. A low-contrast image of the subject is first produced using a photographic film, preferably a fine-grain medium contrast panchromatic film, the image is projected on to a photographic glass plate which is preferably coated with a slow, blue-sensitive high contrast orthochromatic emulsion having very fine grain and very high resolution, a clear varnish is applied to the emulsion side of the glass plate and the image is colored by application of paint to the varnish coating.

6 Claims, 8 Drawing Figures

GLASS PAINTING METHOD

This invention relates to a method for the production of glass paintings and, more particularly, to a method of producing on glass, in the form of painted reproductions, original paintings, engravings, lithographs and like articles whose appeal is primarily aesthetic.

Although mass markets for paintings, engravings and the like can be satisfied to some extent by the production of prints, prints generally tend to lack many of the aesthetically attractive features of originals, in particular, depth of colour characteristic of paintings or fineness of detail.

According to the present invention, there is provided a process for the production of a painted reproduction on glass, hereinafter termed a glass painting, of a painting, engraving, lithograph of like article, hereinafter termed "the subject", which comprises colouring an image of the subject on a glass plate, the image having been produced on the glass plate by photographing the subject using a photographic film, processing the film to produce a low-contrast image and projecting the image on to a photographic glass plate, the emulsion side of the glass plate being coated with a clear varnish prior to colouring the image by application of paint to the varnish coating.

In carrying out the process of this invention, the subject to be copied is photographed. It has been found most suitable to employ a large format (5 inches × 4 inches) fine grain medium contrast panchromatic film. The film is then processed in a fine grain developer selected to give a fairly low contrast image, usually an image having a gamma value of from 0.3 to 0.6, more especially a gamma value of approximately 0.4

If it is desired to alter or retouch the original image in any way, this should be done at this stage. For this purpose, a black and white print is made of the image and the necessary retouching or alterations are carried out on the print. The print is then rephotographed in the aforesaid manner.

In the next stage in the preparation of an outline for painting in of colours, the image on the negative is projected onto a photographic glass plate. The image will usually be enlarged to the size of the intended product. The glass plate onto which the image is projected and usually simultaneously enlarged is preferably coated with a slow, blue-sensitive high contrast orthochromatic emulsion having a very fine grain and very high resolution if an image having characteristics rendering it particularly suitable for further processing is to be obtained. The use of such an emulsion ensures that only the lines in the image are reproduced, the tones disappearing so that only clear glass is left between the lines. The glass is then processed, washed and dried in the normal way for photographic glass plates. Although a variety of formulations can be employed for slow buel-sensitive emulsions, Ilford N-50 plates and Agfa-Gevaert HD plates have been found to be particularly suitable.

Although an image which reproduces in outline features of the desired painting will have been produced, it is generally not practicable to paint in the desired colours on the photographic plate thus produced. The black lines present on the plate at this time will tend to dominate the applied paint too sharply. It is generally desirable to employ a softer lined image at the painting stage. For this purpose, the glass plate is toned by first undergoing immersion in a chemical bath which bleaches out the image, washing the plate and placing it in a toning bath wherein a new image toned the desired colour is obtained. For practical and aesthetic reasons, the image is preferably toned sepia.

Since paint cannot be readily applied to glass, the emulsion side of the glass plate is then coated with a clear varnish and allowed to dry. The varnish used may be any conventionally applied polyurethane-based varnish, preferably a matt varnish or a gloss varnish diluted with turpentine or turpentine substitutes (white spirit) to reduce its gloss. The varnish enables paint to be applied evenly to the glass plate and, if suitably tinted, for example golden-brown, can impart a warm colouration to the painted product subsequently obtained.

Finally, the image is painted by an artist working directly on the varnished side of the glass. The artist is, in fact, "colouring in" the image already on the glass plate. The fine colour detail is preferably first applied with care to improve the depth and quality of the finished painting. When the detailing is dry, normally 24 hours later, the painting in is completed. The colouring is simply blended in on the emulsion side of the plate in accordance with the image thereon. There is no need for skilled attention to detail as all the detail in the finished painting is supplied by the image already provided photographically on the plate. When the additional paint has dried, the glass painting obtained may be utilized for any desired purpose, for example for framing and hanging on the wall, or for a coffee table top.

For a better understanding of the invention and to show how the same can be carried into effect, reference will now be made, by way of example only, to the accompanying drawings which show the stepwise production of a painting on glass by a preferred process embodying this invention. In each of the drawings like reference numerals represent like features.

BRIEF DESCRIPTION OF THE DRAWINGS

FIG. 1 shows a starting glass plate 1 sensitised on one face thereof which, in the sense of the drawing, is the front face of the plate. The sensitising emulsion employed is a slow blue-sensitive emulsion containing gelatin as colloid, silver nitrate and silver bromide as optical sensitisers, plasticisers and stabilisers. Typical plates of this type are Ilford N-50 plates and Agfa-Gevaert HD plates. FIG. 2 shows an image 2 on a negative which has been projected onto the photographic glass plate 1. This image will have been produced by photographing a subject, in this case shown to be a simple cube having a detail 3 for convenience in representation in the drawings, but in practice generally a subject having much greater detail. The subject is photographed using a photographic film which is processed to produce a low-contrast image which is projected onto the photographic glass plate. A large format fine grain medium contrast panchromatic film is preferably employed and the fine grain developer employed preferably has a gamma value of from 0.3 to 0.6.

The image produced on the glass plate 1 in FIG. 2 is quite bold and if a subject containing considerable detail is employed, a substantially black mass of detail will show on the plate. At this stage, the emulsion on the plate 1 contains metallic silver suspended in gelatin containing silica and traces of saponine. All other components of the original emulsion on the plate 1 will have been removed by processing. Hence for practical purposes, it is necessary to reduce the intensity of the image 2 on the plate 1 and accordingly the image is bleached out as shown in FIG. 3, all the metallic silver in the emulsion on the plate being removed. The bleached image is given the reference numeral 2'. The image is now too faint to be of practical value and is toned to the desired intensity. Sepia toning is preferred. FIG. 4 shows the bleached image 2' of FIG. 3 now toned sepia and given the reference numeral 2''.

Figure 1:
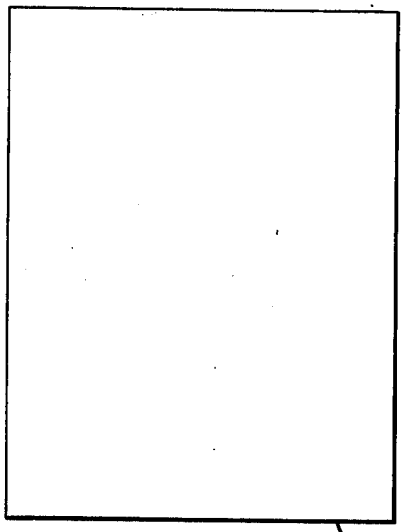
FIG. 1 is a view of a glass plate sensitized on one face.
Figure 2:
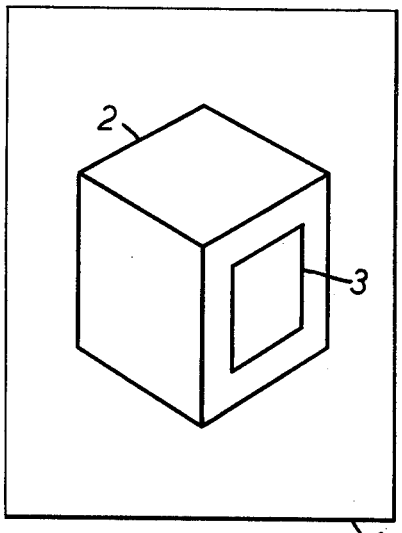
FIG. 2 is a view of an image projected onto a glass plate.
Figure 3:
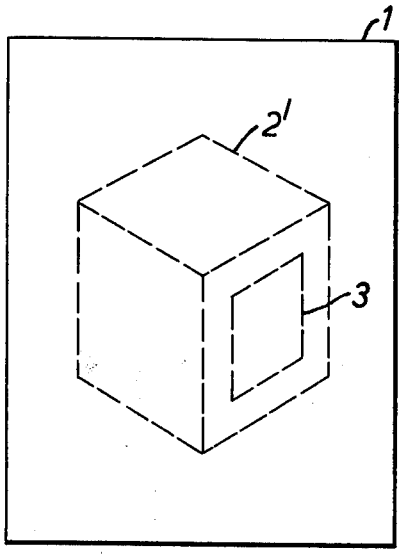
FIG. 3 is a view of a bleached image projected onto a glass plate.
Figure 4:
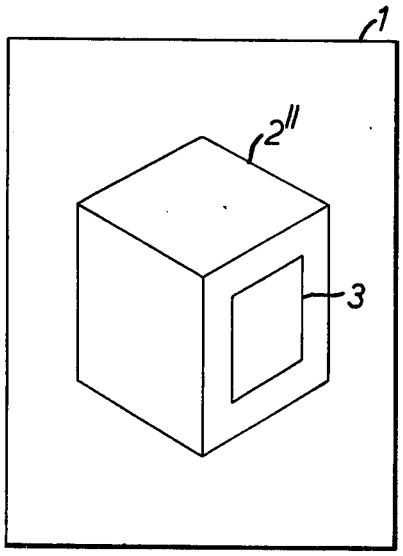
FIG. 4 is a view of a bleached image toned sepia projected onto a glass plate.
Figure 5:
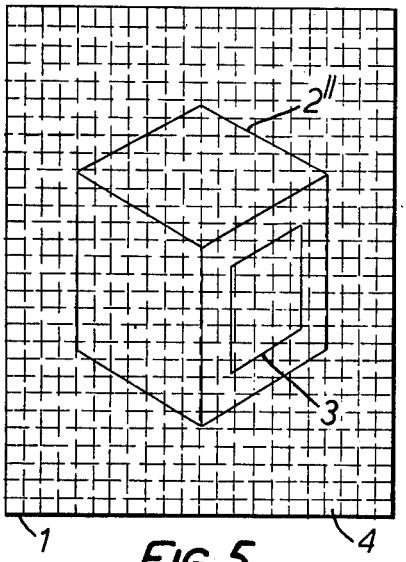
FIG. 5 is a view of a glass plate coated with a varnish.

Referring next to FIG. 5, the emulsion side of the glass plate 1 is provided with a coating 4 of matt polyurethane varnish to which stainer has been added to produce a golden-brown tone. The varnish has the dual effect of protecting the image from being damaged and making it possible for an artist to paint directly onto the varnished image. The golden-brown stainer is employed in preferred practice so that the paint later applied to the glass should be seen through the golden-brown tone which slightly mutes the colour of the paint and gives it a more "antique" appearange.

Figure 6:
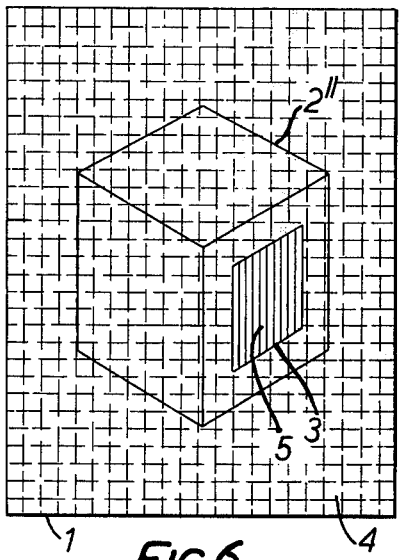
FIG. 6 is a view of a glass plate partially coated with a layer of paint.

Referring next to FIG. 6, the detail 3 of the image is painted in by application to the image on the varnish side of the plate, with care, of a layer of paint 5.

Figure 7:
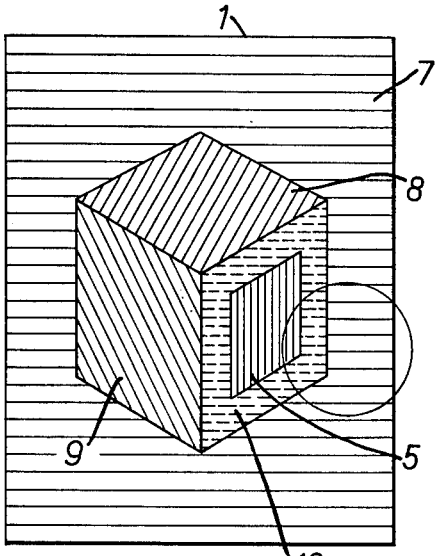
FIG. 7 is a view of a glass plate completely coated with a layer of paint.
Figure 8:
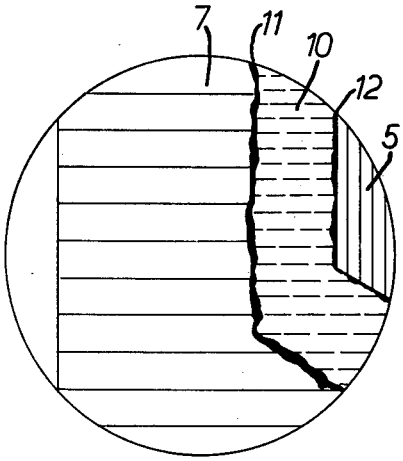
FIG. 8 is a reverse view of FIG. 7.

The final stage in the production of a glass painting is shown in FIG. 7 which shows the finished product obtained by applying paint with somewhat less care to the remaining areas of the image on the glass plate on the varnish side thereof than used in the filling in of the detail 3. The plate is turned over in FIG. 7 whereon it can be seen that the detail of the various features of the image showing through the plate masks any slight imperfection in the application of paint to the varnished side of the plate. Thus additional areas 7, 8, 9 and 10 of the plate hve paint applied thereto. It is appreciated that it is difficult to fully indicate the different visual effects of the two sides of the finished plate since the differences are largely aesthetic. However, reference is finally made to FIG. 8 of the drawings which shows a detail of FIG. 7 in reverse, that is the emulsion/varnish side of the plate, on an enlarged scale. Instead of there being a straight line boundary between the painted areas 7 and 10, there is in fact a narrow zone 11 free from paint. Between the painted area 10 and the detailed area 5 it is a narrow zone 12 which is also free from paint. However, the zone 12 has a straight margin adjacent the area 5 indicating the care with which the detail of the area 5 has been painted in, in contrast to the relatively ragged margin against the area 10.

I claim:

1. A process for the production of a painted reproduction on glass of a subject, which comprises photographing the subject using a fine grain medium contrast panchromatic photographic film, processing the film to produce a low-contrast image, projecting the image on the film as a black image on to a photographic glass plate coated with a slow, blue-sensitive high contrast orthochromatic emulsion having very fine grain and very high resolution, bleaching out the black image produced on said glass plate and toning said image in a colour other than black, coating the emulsion side of the glass plate with a clear varnish, and colouring the image on the glass plate with paint applied to the varnish coating in two stages, paint first being applied to detailed parts of the image in substantially exact conformity with the margins of the detail and paint thereafter being applied to remaining parts of the image after drying the paint applied to the detail parts, the paint being applied to said remaining image parts in such manner that small zones free of paint exist between adjacent painted areas.

2. A process as claimed in claim 1, wherein the film is processed in a fine grain developer selected to give an image having a gamma value of from 0.3 to 0.6, preferably about 0.4.

3. A process as claimed in claim 1, wherein a black and white print is made of the low-contrast image, the image is retouched or altered on the print and the print is photographed using a photographic film and processed to produce the low-contrast image which is projected on to the photographic glass plate.

4. A process as claimed in claim 1, wherein the image is enlarged as it is projected on to the photographic glass plate.

5. A process as claimed in claim 1, wherein the image on the glass plate is toned sepia.

6. A process as claimed in claim 1, wherein the varnish applied to the emulsion side of the photographic glass plate is a matt polyurethane varnish.

* * * * *